US008381824B2

(12) United States Patent
Lee

(10) Patent No.: US 8,381,824 B2
(45) Date of Patent: Feb. 26, 2013

(54) FIRE EXTINGUISHING GAS EMISSION CONTROL APPARATUS

(75) Inventor: Yeu Yong Lee, Seoul (KR)

(73) Assignee: Chang Sung Ace Co., Ltd., Gyeonggi-Do (KR)

( * ) Notice: Subject to any disclaimer, the term of this patent is extended or adjusted under 35 U.S.C. 154(b) by 0 days.

(21) Appl. No.: 13/235,702

(22) Filed: Sep. 19, 2011

(65) Prior Publication Data

US 2012/0073837 A1 Mar. 29, 2012

(30) Foreign Application Priority Data

Sep. 28, 2010 (KR) ..... 10-2010-0093595

(51) Int. Cl.
*A62C 35/00* (2006.01)

(52) U.S. Cl. ..... 169/11; 239/67; 239/69; 239/71

(58) Field of Classification Search ..... 169/11, 169/48–50; 239/67–74
See application file for complete search history.

(56) References Cited

U.S. PATENT DOCUMENTS 2,023,569 A * 12/1935 Allen et al. ..... 169/11
5,676,712 A * 10/1997 Anderson ..... 48/192
5,857,525 A * 1/1999 Okamoto et al. ..... 169/11

FOREIGN PATENT DOCUMENTS

| | | |
|---|---|---|
| JP | 06-119582 | 4/1994 |
| JP | 06-210018 | 8/1994 |
| JP | 09-201458 | 8/1997 |
| JP | 11-089962 | 4/1999 |

* cited by examiner

*Primary Examiner* — Christopher Kim
(74) *Attorney, Agent, or Firm* — IPLA P.A.; James E. Bame

(57) ABSTRACT

Disclosed herein is a fire extinguishing gas emission control apparatus for a protected area. The fire extinguishing gas emission control apparatus includes a mode conversion unit, and a control unit. The mode conversion unit includes a stop switch capable of selecting an on-mode used to prevent fire extinguishing gas from being emitted into the protected area or an off-mode used to allow the fire extinguishing gas to be emitted into the protected area. The control unit performs control such that the interlock circuit unit of the gas fire extinguishing equipment apparatus is put in on or off-mode based on the on or off-mode of the stop switch. The mode conversion unit further includes a Radio Frequency (RF) card recognition unit capable of recognizing an RF card in which the ID of a passer-by who enters the protected area is stored.

7 Claims, 6 Drawing Sheets

FIRE EXTINGUISHING GAS EMISSION CONTROL APPARATUS

CROSS REFERENCE

This application claims foreign priority under Paris Convention and 35 U.S.C. §119 to Korean Patent Application No. 10-2010-0093595, filed Sep. 28, 2010 with the Korean Intellectual Property Office.

BACKGROUND OF THE INVENTION

1. Technical Field

The present invention relates generally to a fire extinguishing gas emission control apparatus, and, more particularly, to a fire extinguishing gas emission control apparatus, which controls the interlock circuit unit of a gas fire extinguishing equipment apparatus related to an area in which disasters should be prevented (hereinafter referred to as "protected area"), thereby controlling whether the emission of a fire extinguishing gas will be prevented in a protected area.

2. Description of the Related Art

The present invention relates to a fire extinguishing gas emission control apparatus.

When a person enters a protected area in order to perform a specific task, fire extinguishing gas may be abnormally or normally emitted. Therefore, existing fire extinguishing gas emission control apparatuses are problematic because the person in the protected area may be injured or damaged due to fire extinguishing gas being emitted therein.

SUMMARY OF THE INVENTION

Accordingly, the present invention has been made keeping in mind the above problems occurring in the prior art, and an object of the present invention is to provide a fire extinguishing gas emission control apparatus which, when a person (passer-by) enters a protected area, controls the interlock circuit unit of a gas fire extinguishing equipment apparatus by operating a stop switch, so that fire extinguishing gas can be prevented from being emitted into the protected area.

Another object of the present invention is to provide a fire extinguishing gas emission control apparatus which transmits information that notifies a disaster protection center related to the protected area whether fire extinguishing gas is prevented from being emitted into a protected area, thereby securely managing disaster protection.

In order to accomplish the above objects, the present invention provides a fire extinguishing gas emission control apparatus for a protected area, the fire extinguishing gas emission control apparatus controlling whether to prevent fire extinguishing gas from being emitted using the interlock circuit unit of a gas fire extinguishing equipment apparatus, the fire extinguishing gas emission control apparatus including: a mode conversion unit configured to include a stop switch capable of selecting an on-mode used to prevent fire extinguishing gas from being emitted into the protected area or an off-mode used to allow the fire extinguishing gas to be emitted into the protected area; and a control unit configured to perform control such that the interlock circuit unit of the gas fire extinguishing equipment apparatus is put in on or off-mode based on the on or off-mode of the stop switch; and wherein the mode conversion unit may further include a Radio Frequency (RF) card recognition unit capable of recognizing an RF card in which the ID of a passer-by who enters the protected area is stored; wherein the control unit is connected to an entrance/exit information server including a passer-by information DB for storing the ID information of passers-by who have permission to enter the protected area, and is configured to perform control such that the mode of the interlock circuit unit of the gas fire extinguishing equipment apparatus is put in the on-mode status based on the on-mode of the stop switch only when the ID of a passer-by, which was recognized by the RF card recognition unit, is identical to that of the passer-by information DB; and wherein the control unit transmits information about the on or off-mode status of the interlock circuit unit of the gas fire extinguishing equipment apparatus and the ID information of the passer-by, which was recognized by the RF card recognition unit, to the control server of a disaster prevention center that manages fire protection status for the protected area.

Further, the mode conversion unit may further include a timer capable of inputting a time that the on-mode status of the stop switch is maintained when the on-mode of the stop switch is selected; and the control unit may perform control such that the on-mode status of the interlock circuit unit of the gas fire extinguishing equipment apparatus is maintained only for a time which was input to the timer.

Further, the fire extinguishing gas emission control apparatus may further include a warning unit which includes a first lamp for displaying that the interlock circuit unit of the gas fire extinguishing equipment apparatus is in on-mode status using the control unit.

Further, the warning unit may further include a first counter for displaying a time that the interlock circuit unit of the gas fire extinguishing equipment apparatus will be maintained in the on-mode status.

Further, the fire extinguishing gas emission control apparatus may further include a wireless communication unit; and wherein the control unit may wirelessly transmit a signal, related to information about the on or off-mode status of the interlock circuit unit of the gas fire extinguishing equipment apparatus, and a signal, related to the ID information of the passer-by that was recognized by the RF card recognition unit, to the control server of the disaster protection center, the control server being connected to a wireless communication module.

Further, the fire extinguishing gas emission control apparatus may further include an intercom capable of performing communication with the disaster protection center by means of a human voice.

Further, the control unit may perform control such that the status of each of the stop switch and the interlock circuit unit of the gas fire extinguishing equipment apparatus is switched from the on-mode status back to the off-mode status when an RF card, recognized by the RF card recognition unit and being carried by the passer-by who entered the protected area, is recognized by the RF card recognition unit again.

Further, the control unit, when there are a plurality of RF cards which were recognized by the RF card recognition unit and were being carried by passers-by who entered the protected area, may perform control such that the status of each of the stop switch and the interlock circuit unit of the gas fire extinguishing equipment apparatus is switched from the on-mode status back to the off-mode status only when all of the RF cards, which were recognized by the RF card recognition unit and were being carried by passers-by who entered the protected area, were recognized by the RF card recognition unit again.

BRIEF DESCRIPTION OF THE DRAWINGS

The above and other objects, features and further advantages of the present invention will be more clearly understood from the following detailed description taken in conjunction with the accompanying drawings, in which.

DESCRIPTION OF THE PREFERRED EMBODIMENTS

Figure 1:
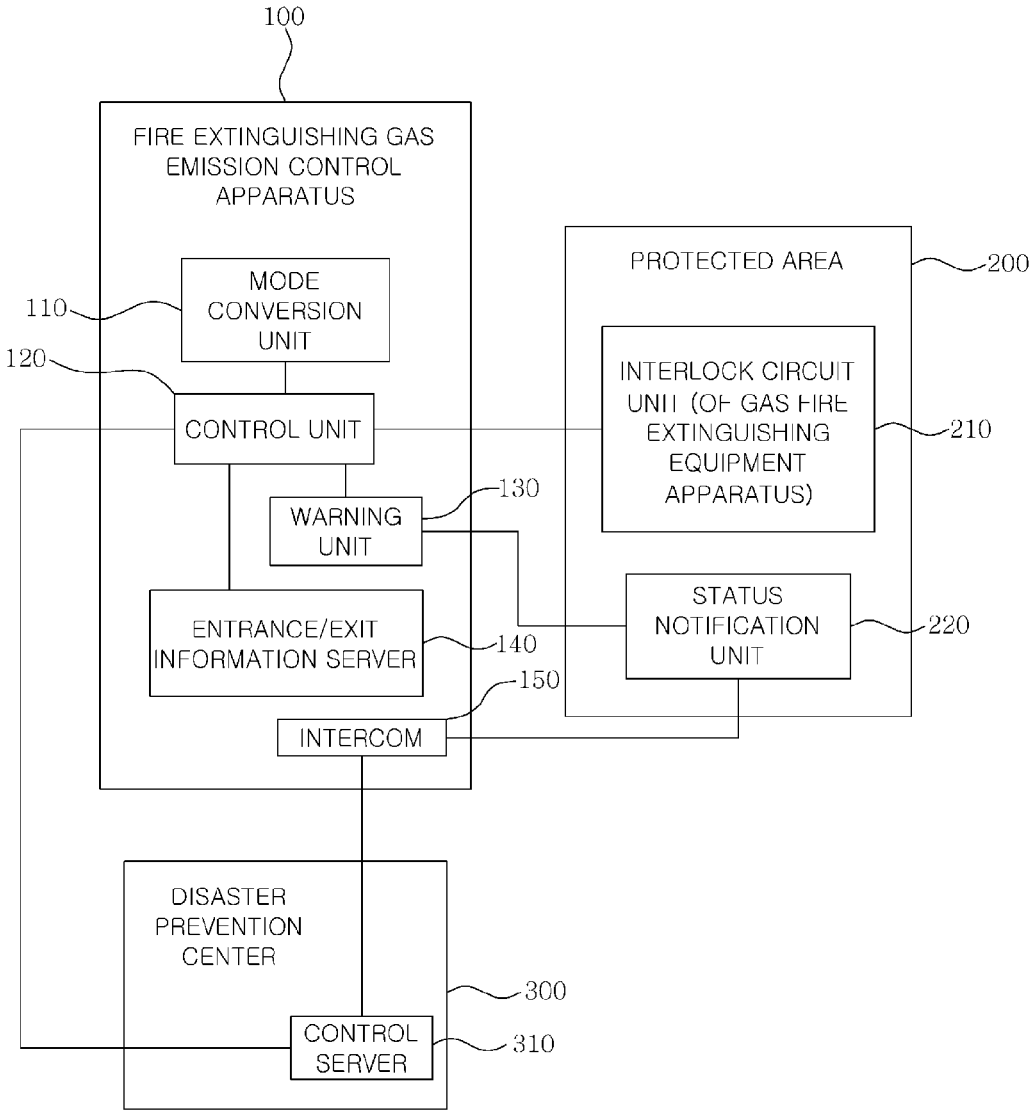
FIGS. 1 and 2 are block diagrams illustrating a fire extinguishing gas emission control apparatus according to an embodiment of the present invention.

Other details of embodiments are included in detailed description and the accompanying drawings.

The advantages, features, and methods of accomplishing the invention will be clearly explained with reference to the embodiments which will be described in detail with reference to the accompanying drawings.

However, the present invention is not limited to the disclosed embodiments below and may be implemented using various other embodiments which are different from each other. The present embodiments are provided to only complete the disclosure of the present invention and to completely inform those skilled in the art of the scope of the present invention. The present invention is to be defined by the scope of the claims. Reference now should be made to the drawings, throughout which the same reference numerals are used to designate the same or similar components.

The present invention will be described with reference to the drawings used to describe the fire extinguishing gas emission control apparatus according to the embodiment of the present invention.

Figure 2:
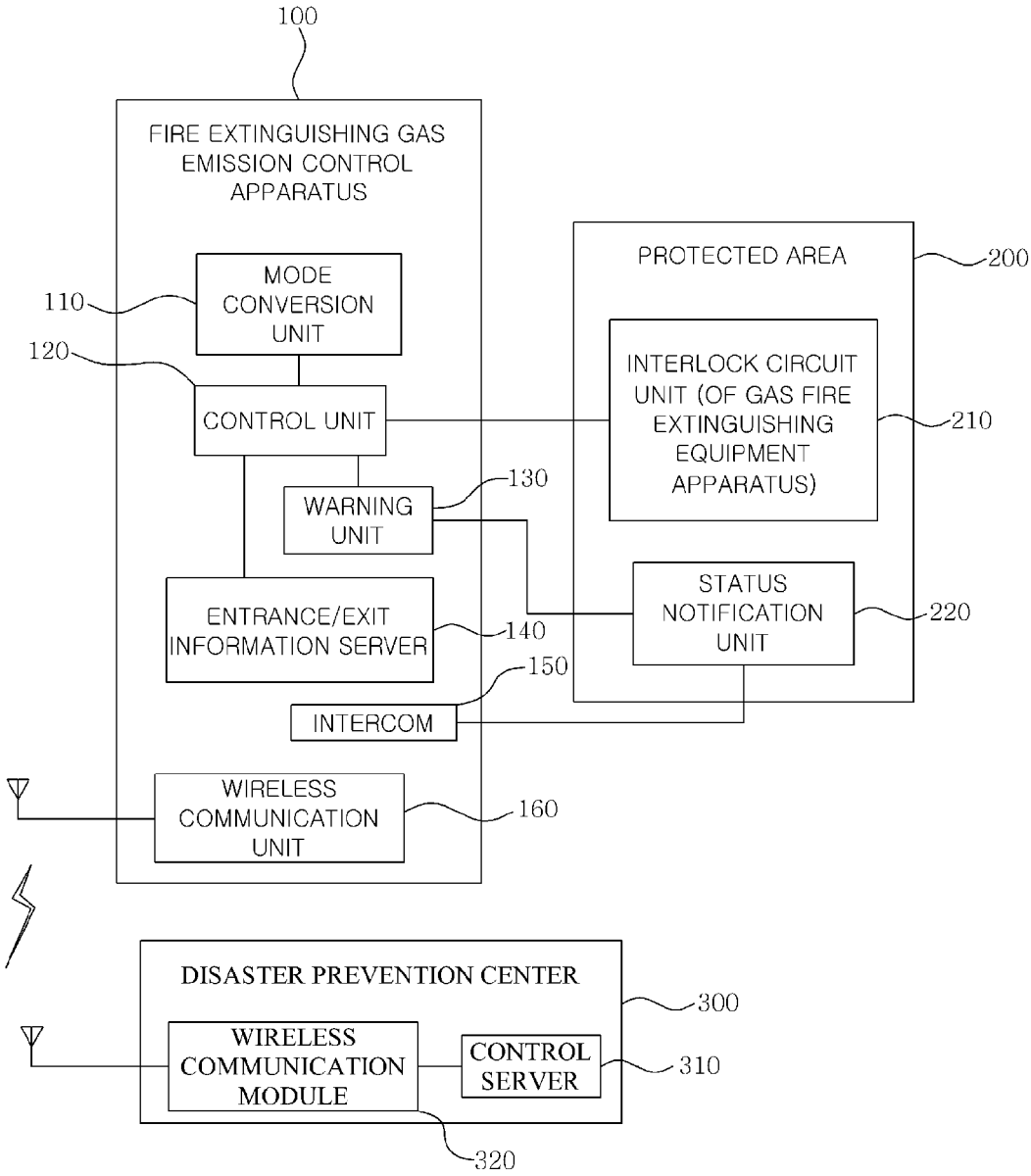
Figure 3:
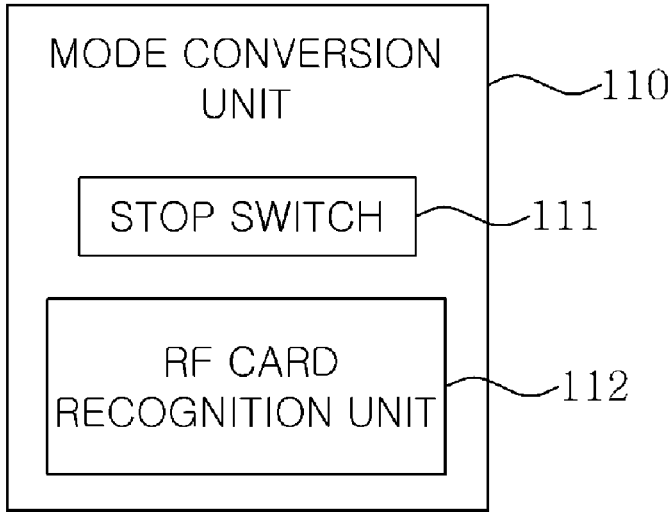
FIGS. 3 to 6 are block diagrams each illustrating a mode conversion unit.
Figure 4:
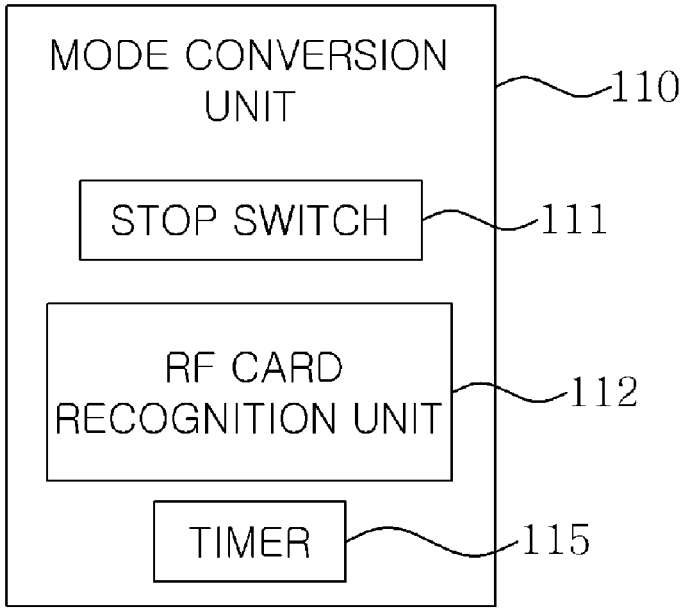
Figure 5:
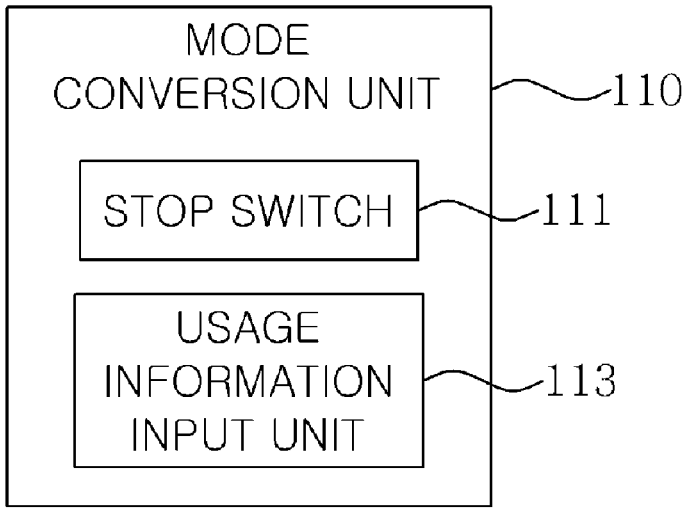
Figure 6:
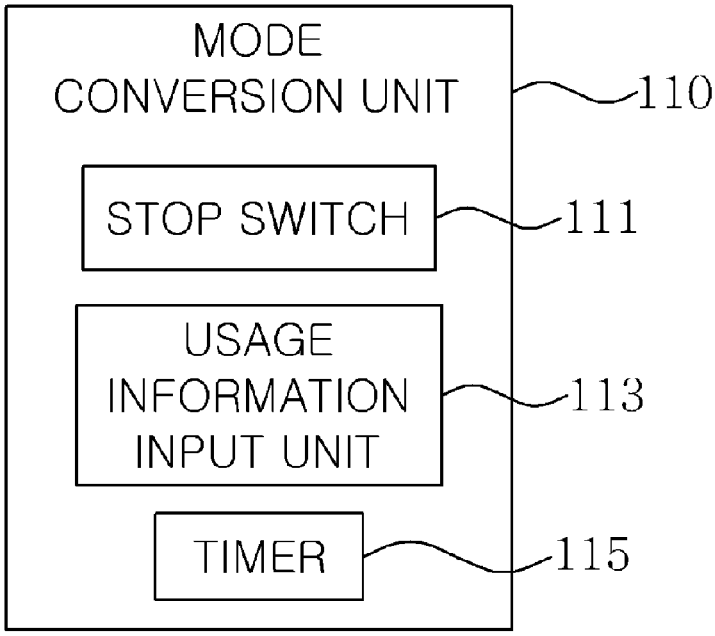
Figure 7:
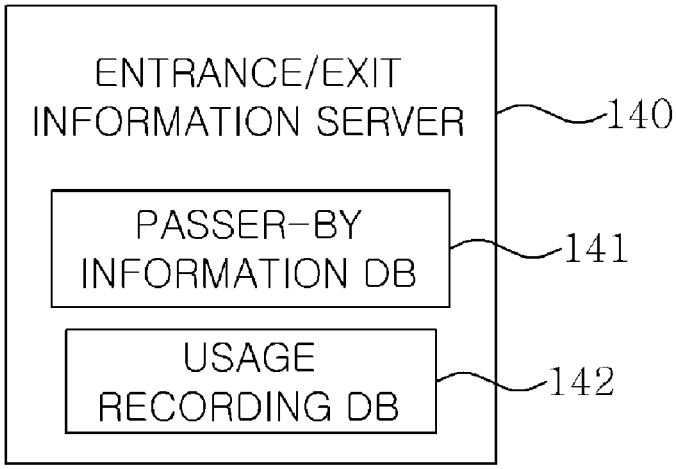
FIG. 7 is a block diagram illustrating an entrance/exit information server.

FIGS. 1 and 2 are block diagrams illustrating a fire extinguishing gas emission control apparatus, a protected area, and a disaster protection center according to the embodiment of the present invention, FIGS. 3 to 6 are block diagrams each illustrating a mode conversion unit, and FIG. 7 is a block diagram illustrating an entrance/exit information server.

The term "protected area" means a specific area, such as a factory or a building, which is set such that fire extinguishing gas is automatically sprayed in order to prevent disasters attributable to fire and other types of combustion.

The fire extinguishing gas emission control apparatus 100 according to the embodiment of the present invention is a fire extinguishing gas emission control apparatus for such a protected area 200. The fire extinguishing gas emission control apparatus determines whether to prevent fire extinguishing gas from being emitted using the interlock circuit unit 210 of a gas fire extinguishing equipment apparatus. The fire extinguishing gas emission control apparatus 100 includes a mode conversion unit 110 configured to include a stop switch 111 capable of selecting an on-mode used to prevent fire extinguishing gas from being emitted into the protected area and an off-mode used to allow the fire extinguishing gas to be emitted into the protected area, and a control unit 120 configured to perform control such that the interlock circuit unit 210 of the gas fire extinguishing equipment apparatus is put in on or off-mode based on the on or off-mode of the stop switch 111.

The fire extinguishing gas emission control apparatus 100 according to the present invention includes the mode conversion unit 110 and the control unit 120.

Here, the mode conversion unit 110 includes the stop switch 111 capable of determining whether to prevent the fire extinguishing gas from being emitted into the protected area 200 using the interlock circuit unit 210 of the gas fire extinguishing equipment apparatus.

The stop switch 111 includes on-mode and off-mode.

When the stop switch 111 is in on-mode status, the mode of the interlock circuit unit 210 is converted into on-mode status, thereby preventing fire extinguishing gas from being emitted into the protected area. When the stop switch 111 is in off-mode status, the mode of the interlock circuit unit 210 is converted into off-mode status, thereby allowing fire extinguishing gas to be emitted into the protected area.

That is, the stop switch 111 is usually maintained in the off-mode status, that is, the status in which fire extinguishing gas may be automatically emitted into the protected area if a fire occurs. When a passer-by who works in the protected area enters the protected area, the mode of the stop switch 111 is converted into on-mode, thereby preventing the fire extinguishing gas from being emitted into the protected area.

Various types of switches, such as a general switch, a rotation type switch, and a button type switch, may be used as the stop switch 111.

The control unit 120 performs control such that the interlock circuit unit 210 of the gas fire extinguishing equipment apparatus is put in on or off-mode status based on the on or off-mode of the stop switch 111.

Here, the interlock circuit unit 210 performs a function of, when a passer-by enters the protected area, preventing fire extinguishing gas from being emitted until the passer-by leaves the protected area in order to protect the passer-by. Since the configuration and operational principle of the interlock circuit unit are well known, the description thereof will be omitted.

That is, in normal status, that is, when the stop switch 111 is in off-mode, the interlock circuit unit 210 is also maintained in off-mode status. Therefore, when a fire occurs in the protected area, fire extinguishing gas is automatically emitted into the protected area. When the mode of the stop switch 111 is converted into the on-mode, the mode of the interlock circuit unit 210 is also switched to on-mode, so that the emission of fire extinguishing gas into the protected area is prevented compulsorily.

Here, the control unit 120 is connected to the mode conversion unit 110, and is configured to perform a function of performing control such that the interlock circuit unit 210 is put in on or off-mode status based on the on or off-mode status of the stop switch 111.

The fire extinguishing gas emission control apparatus 100 may further include an entrance/exit information server 140.

Here, the entrance/exit information server 140 includes a passer-by information DB which stores passer-by's Identity (ID) information, such as the IDs, corresponding passwords (used to enter the protected area) and departments of all the passers-by who can enter the protected area 200.

Further, the mode conversion unit 110 may further include a Radio Frequency (RF) card recognition unit 112.

Here, an RF card stores the ID of each passer-by who can enter the protected area 200, and the RF card recognition unit 112 recognizes the RF card.

That is, the mode conversion unit 110 further includes the RF card recognition unit 112 capable of recognizing an RF card which stores the ID of a passer-by who enters the protected area. The control unit 120 is connected to the entrance/exit information server 140 which includes the passer-by information DB 141 for storing the ID information for each passer-by who has permission to enter the protected area 200. Only when the ID of a specific passer-by, which was recognized by the RF card recognition unit 112, is identical with that of the passer-by information DB 141, the control unit 120 performs control such that the status of the interlock circuit unit 210 of the gas fire extinguishing equipment apparatus is changed to on-mode status based on the on-mode of the stop switch 111.

The mode conversion unit 110 may further include a usage information input unit 113 instead of the RF card recognition unit 112, or may include both the usage information input unit 113 and the RF card recognition unit 112.

The usage information input unit 113 performs a function of receiving the IDs or passwords of respective passers-by who enter the protected area 200.

That is, the mode conversion unit 110 further includes the usage information input unit 113 for receiving the IDs or passwords of the respective passers-by who enter the protected area. The control unit 120 is connected to the entrance/exit information server 140 which includes the passer-by information DB 141 for storing ID or password information about each of passers-by who has permission to enter the protected area. Only when the ID or password of a passer-by, which was input to the information input unit 113, is identical with that of the passer-by information DB 141, the control unit 120 performs control such that the status of the interlock circuit unit 210 of the gas fire extinguishing equipment apparatus is changed to on-mode status based on the on-mode of the stop switch 111.

The entrance/exit information server 140 may further include a usage recording DB 142 together with the passer-by information DB 141.

The usage recording DB 142 is electrically connected to the control unit 120, and is configured to record the IDs of passers-by, which were recognized using the RF card recognition unit 112 or input using the usage information input unit 113, a time that a corresponding passer-by stayed in the protected area, and the time of timer 115 which will be described later.

In the fire extinguishing gas emission control apparatus according to the present invention having the above-described configuration, the control unit 120 may perform control such that the stop switch 111 and the interlock circuit unit 210 of the gas fire extinguishing equipment apparatus are converted from on-mode status to off-mode status again when the RF card, which is recognized by the RF card recognition unit 112 and carried by a passer-by who entered the protected area, is recognized by the RF card recognition unit 112 again.

Further, when there are a plurality of RF cards which are recognized by the RF card recognition unit 112 and carried by the respective passers-by who entered the protected area, the control unit 120 may perform control such that the stop switch 111 and the interlock circuit unit 210 of the gas fire extinguishing equipment apparatus are converted from on-mode status to off-mode status again when the RF cards, which were recognized by the RF card recognition unit 112 and were being carried by the respective passers-by who entered the protected area, are recognized by the RF card recognition unit 112 again.

Further, as shown in FIGS. 5 and 6, the mode conversion unit 110 further includes a timer 115 capable of inputting a time that the on-mode status of the stop switch 111 is maintained when the on-mode of the stop switch 111 is selected. The control unit 120 may perform control such that the on-mode status of the interlock circuit unit 210 of the gas fire extinguishing equipment apparatus can be maintained only for the time that was input into the timer.

That is, if the mode of the stop switch 111 is converted into on-mode and then a predetermined time is input to the timer 115, the control unit 120 performs control such that the mode of the interlock circuit unit 210 is converted into on-mode status for the predetermined time, thereby preventing fire extinguishing gas from being emitted into the protected area 200.

Figure 8:
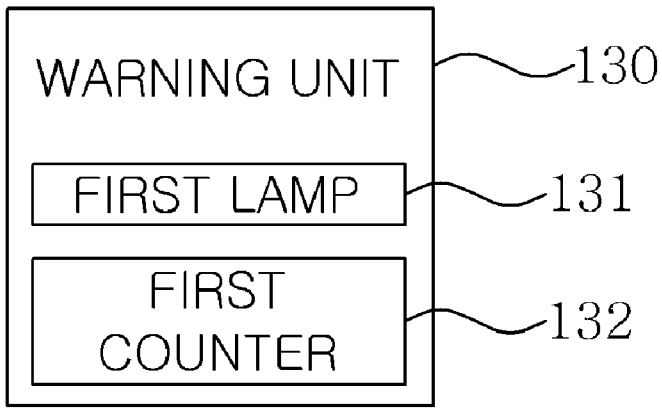
FIG. 8 is a block diagram illustrating a warning unit.
Figure 9:
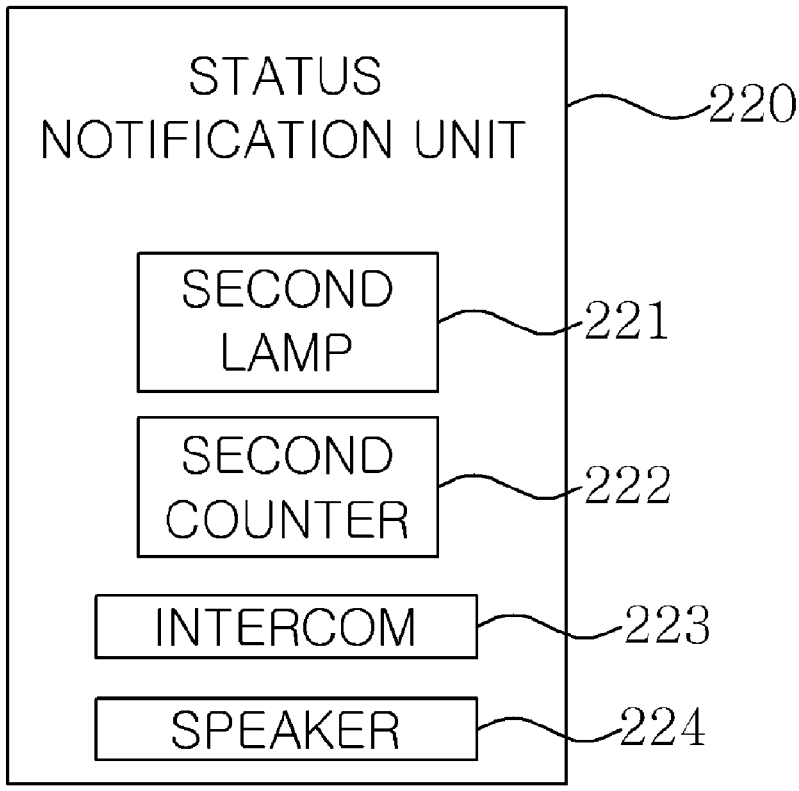
FIG. 9 is a block diagram illustrating a status notification unit in a protected area.

FIG. 8 is a block diagram illustrating a warning unit.

The fire extinguishing gas emission control apparatus 100 according to the present invention may further include a warning unit 130.

The warning unit 130 includes a first lamp 131 that displays the situation where the on-mode of the stop switch 111 is selected, and the mode of the interlock circuit unit 210 is converted into on-mode status using the control unit 120, thereby preventing fire extinguishing gas from being emitted into the protected area 200.

Here, the warning unit 130 may further include a first counter 132 for displaying the time that the interlock circuit unit 210 of the gas fire extinguishing equipment apparatus maintained in on-mode status.

That is, the first counter 132 displays the time that the on-mode of the stop switch 111, which is set by the timer 131, will be maintained, that is, the time that the mode of the stop switch 111 is switched back to off-mode and the status of the interlock circuit unit 210 is switched back to off-mode status, so that status is changed such that fire extinguishing gas may be emitted into the protected area 200 as normal.

The protected area 200 may be further provided with a status notification unit 220, together with the interlock circuit unit 210 of the gas fire extinguishing equipment apparatus.

The status notification unit 220 is electrically connected to the control unit, and is configured to further include a second lamp 221 for displaying that the current mode status of the protected area 200, that is, the status of each of the stop switch 111 and the interlock circuit unit 210 corresponds to on-mode status, and the emission of fire extinguishing gas into the protected area 200 is controlled so as to be prevented.

Here, the status notification unit 220 may further include a second counter 222 for performing display such that a time, which is the same as the time displayed using the first counter 132 of the warning unit 130, can be checked in the protected area 200.

The control unit 120 is electrically connected to the control server 310 of the disaster prevention center 300 for managing a disaster prevention system related to the protected area 200.

Here, the control unit 120 transmits information about the on or off-mode status of the interlock circuit unit 210 of the gas fire extinguishing equipment apparatus to the control server 310 of the disaster prevention center 300 that manages the fire protection status of the protected area 200.

Here, the control unit 120 may further transmit passer-by ID information, recognized by the RF card recognition unit 112 or input to the usage information input unit 113, or information about a predetermined time, input to the timer 115, to the control server 310.

That is, the disaster prevention server 310 stores status information related to whether to prevent fire extinguishing gas from being emitted into the protected area 200 and stores information about passers-by who entered the protected area, so that the disaster prevention center 300 can more thoroughly manage the protected area.

The fire extinguishing gas emission control apparatus 100 according to the present invention may further include a wireless communication unit 160 electrically connected to the control unit 120 such that wireless communication can be made with the disaster protection center.

Here, the disaster prevention center 300 further includes a wireless communication module 320 capable of performing wireless communication with the wireless communication unit 160, in addition to with the control server 310. The wireless communication module 320 is electrically connected to the control server 310, and is configured to receive a signal which is received from the wireless communication unit 160 and related to information about the on or off-mode of the interlock circuit unit 210 of the gas fire extinguishing equipment apparatus, the passer-by's ID information recognized by the RF card recognition unit 112 or input to the usage information input unit 113, and a signal related to information about a predetermined time input to the timer 115, and is configured to transmit the received signals and information to the control server 310.

That is, the fire extinguishing gas emission control apparatus 100 may further include the wireless communication unit 160, and the control unit 120 may wirelessly transmit a signal which is related to information about the on or off-mode status of the interlock circuit unit 210 of the gas fire extinguishing equipment apparatus and a signal which is related to the passer-by's ID information recognized by the RF card recognition unit 112 or input to the usage information input unit 113 to the control server 310 of the disaster protection center, the control server 310 being connected to the wireless communication module 320.

Further, the fire extinguishing gas emission control apparatus 100 may further include an intercom 150.

Here, the status notification unit 220 in the protected area 200 further includes an intercom 223 and a speaker 224.

A passer-by who enters the protected area 200 using the intercom 160 may directly provide notification of the entrance to the protected area 200 to the disaster prevention center 300 by means of a human voice, and may confirm that the modes of the stop switch 111 and the interlock circuit unit 210 have been converted into on-mode status.

Further, it is possible to use the intercom 160 and the intercom and speaker of the status notification unit 220 to communicate with a passer-by who is performing a task in the protected area 200 or to notify the passer-by of matters requiring attention.

A fire extinguishing gas emission control system according to another embodiment of the present invention will be described below.

The fire extinguishing gas emission control system according to the present invention uses a fire extinguishing gas emission control apparatus provided at the entrance to each of a plurality of protected areas 200 in which control is made to determine whether to prevent fire extinguishing gas from being emitted using the interlock circuit unit of the gas fire extinguishing equipment apparatus. The fire extinguishing gas emission control apparatus 100, provided in the entrance to each of the plurality of protected areas 200, includes a mode conversion unit 110 configured to include a stop switch 111 capable of selecting on-mode which is used to prevent fire extinguishing gas from being emitted into the protected area 200 and off-mode which is used to allow fire extinguishing gas to be emitted into the protected area, and includes a control unit 120 configured to perform control such that the interlock circuit unit 210 of the gas fire extinguishing equipment apparatus is put in on or off-mode based on the on or off-mode of the stop switch 111. The mode conversion unit 110 includes an RF card recognition unit 112 capable of recognizing an RF card in which the ID of a passer-by who enters the protected area 200 is stored and capable of recognizing the checking in and checking out performed by the passer-by into and from the protected area, and a timer 115 capable of inputting the time that the stop switch 111 will be maintained in on-mode when the on-mode of the stop switch 111 has been selected. The control unit 120 is connected to an entrance/exit information server 140 including a passer-by information DB 141 for storing the ID information of passers-by who have permission to enter the protected area 200. The control unit 120 is configured to perform control such that the interlock circuit unit 210 of the gas fire extinguishing equipment apparatus is put in on-mode status based on the on-mode of the stop switch 111 only when the ID of a specific passer-by, which was recognized as having checked in by the RF card recognition unit 112, is identical with that of the passer-by information DB 141. The control unit 120 is configured to perform control such that the modes of the stop switch 111 and the interlock circuit unit 210 of the gas fire extinguishing equipment apparatus are switched back to off-mode status when the ID of the specific passer-by, which was recognized as having checked in by the RF card recognition unit 112, is recognized as having checked out by the RF card recognition unit 112 or when the time input to the timer 115 has elapsed. A disaster prevention center 300 for managing the fire protection status of the protected area includes a control server 310. The control server 310 is configured to receive information about the on or off mode status of the stop switch 111 and the interlock circuit unit 210 of the gas fire extinguishing equipment apparatus, and information about the IDs of respective passers-by who were recognized as having checked in or out of the protected area 200 by the RF card recognition unit 112 from the control unit 120 and configured to store the information, and configured to include a passer-by personal information DB (not shown) including the IDs and mobile communication terminal numbers of respective passers-by who have permission to enter the protected area 200. The control server 310 may receive a selection signal, used to determine whether to extend the time input to the timer 115, from a mobile communication terminal connected to a commercial wired/wireless telephone communication network of the disaster prevention center 300 and connected to the control server 310. When a selection signal, used to extend the time input to the timer 115, is received, the control server 310 transmits a timer extension signal to the control unit 120 of a fire extinguishing gas emission control apparatus, in which the ID of the passer-by is recognized as having checked in, only when the mobile communication terminal number stored in the passer-by personal information DB is identical to the mobile communication terminal number connected to the control server 310 or when the ID of the passer-by, which corresponds to the phone number of the mobile communication terminal connected to the control server 310, is recognized as having checked in. The control unit 120 which received the timer extension signal performs control such that the time, input to the timer 115, is extended by as long as the time which was previously input, so that the on-mode status of each of the stop switch 111 and the interlock circuit unit 210 of the gas fire extinguishing equipment apparatus is maintained for the duration of the extended time.

Here, the configuration of a fire extinguishing gas emission control system is the same as that described for the fire extinguishing gas emission control apparatus.

That is, when a passer-by, who entered the protected area after having his or her RF card be recognized by the RF card recognition unit 112 of the mode conversion unit 110 and selecting the stop switch 111 to be in on-mode, should perform a task in the protected area for period of time longer than the time input to the timer 115, the passer-by who entered the protected area may keep the stop switch 111 and the interlock circuit unit 210 in the on-mode status as long as necessary simply by manipulating the time of the timer 115 using a mobile communication terminal (mobile phone) without leaving the protected area and manipulating the mode conversion unit 110.

That is, if the passer-by in the protected area accesses the control server 310 of the disaster prevention center 300 using a mobile phone, the control server 310 checks a specific button signal (for example, a pound key button or a star key button) used to extend the input time of the timer of the mobile communication terminal and for the number of the mobile communication terminal which accessed the control server.

When a signal related to the extension of time input to the timer is received and the number of the mobile communication terminal (the mobile phone number) which transmitted the corresponding signal is identical to the mobile phone number stored in the passer-by personal information DB, the control server 310 transmits the signal related to the extension of time input to the timer 115 to the control unit 120 of the fire extinguishing gas emission control apparatus 100, which has recognized as having checked in but not as having checked out.

The control unit 120, which received the signal related to the extension of time input to the timer 115, extends the time which was input to the timer 115 of the corresponding fire extinguishing gas emission control apparatus 100, and performs control such that the stop switch 111 and the interlock circuit unit 210 are maintained in on-mode status for the duration of the extended time.

Here, when the extended time, input to the timer 115, has elapsed, the control unit 120 switches the mode of each of the stop switch 111 and the interlock circuit unit 210 from on-mode status to off-mode status as described above, thereby performing control such that status in which the emission of fire extinguishing gas is allowed is maintained in the protected area.

The above-described present invention can provide a fire extinguishing gas emission control apparatus which, when a person (passer-by) enters a protected area, controls the interlock circuit unit of a gas fire extinguishing equipment apparatus by operating a stop switch, so that fire extinguishing gas can be prevented from being emitted into the protected area.

Further, the present invention can provide a fire extinguishing gas emission control apparatus which transmits information that notifies a disaster protection center related to the protected area whether fire extinguishing gas is prevented from being emitted into a protected area, thereby securely managing disaster protection.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A control system comprising a fire extinguishing gas emission control apparatus and a gas fire extinguishing equipment apparatus, wherein the fire extinguishing gas emission control apparatus comprising:

a mode conversion unit configured to include a stop switch capable of selecting an on-mode used to prevent fire extinguishing gas from being emitted into a protected area or an off-mode used to allow the fire extinguishing gas to be emitted into the protected area; and a control unit configured to perform control such that an interlock circuit unit of the gas fire extinguishing equipment apparatus is put in on or off-mode based on the on or off-mode of the stop switch thereby the interlock circuit unit serving to control emission of fire extinguish gas; and wherein the mode conversion unit further comprises a Radio Frequency (RF) card recognition unit capable of recognizing an RF card in which an ID of a passer-by who enters the protected area is stored;

wherein the control unit is connected to an entrance/exit information server including a passer-by information DB for storing ID information of passers-by who have permission to enter the protected area, and is configured to perform control such that the mode of the interlock circuit unit of the gas fire extinguishing equipment apparatus is put in the on-mode status based on the on-mode of the stop switch only when an ID of a passer-by, which was recognized by the RF card recognition unit, is identical to that of the passer-by information DB; and wherein the control unit transmits information about the on or off-mode status of the interlock circuit unit of the gas fire extinguishing equipment apparatus and the ID information of the passer-by, which was recognized by the RF card recognition unit, to a control server of a disaster prevention center that manages fire protection status for the protected area.

2. The control system as set forth in claim 1, wherein:

the mode conversion unit further comprises a timer capable of inputting a time that the on-mode status of the stop switch is maintained when the on-mode of the stop switch is selected; and the control unit performs control such that the on-mode status of the interlock circuit unit of the gas fire extinguishing equipment apparatus is maintained only for a time which was input to the timer.

3. The control system as set forth in claim 2, wherein the fire extinguishing gas emission control apparatus further comprises a warning unit which comprises a first lamp for displaying that the interlock circuit unit of the gas fire extinguishing equipment apparatus is in on-mode status using the control unit.

4. The control system as set forth in claim 3, wherein the warning unit further comprises a first counter for displaying a time that the interlock circuit unit of the gas fire extinguishing equipment apparatus will be maintained in the on-mode status.

5. The control system as set forth in claim 1, wherein the fire extinguishing gas emission control apparatus further comprises an intercom capable of performing communication with the disaster protection center by means of a human voice.

6. The control system as set forth in claim 1, wherein the control unit performs control such that the status of each of the stop switch and the interlock circuit unit of the gas fire extinguishing equipment apparatus is switched from the on-mode status back to the off-mode status when an RF card, recognized by the RF card recognition unit and being carried by the passer-by who entered the protected area, is recognized by the RF card recognition unit again.

7. The control system as set forth in claim 1, wherein the control unit, when there are a plurality of RF cards which were recognized by the RF card recognition unit and were being carried by passers-by who entered the protected area, performs control such that the status of each of the stop switch and the interlock circuit unit of the gas fire extinguishing equipment apparatus is switched from the on-mode status back to the off-mode status only when all of the RF cards, which were recognized by the RF card recognition unit and were being carried by passers-by who entered the protected area, were recognized by the RF card recognition unit again.

* * * * *